US005692673A

United States Patent [19]

De Safey

[11] Patent Number: 5,692,673

[45] Date of Patent: Dec. 2, 1997

[54] APPARATUS FOR CONNECTED FILE FOLDERS

[76] Inventor: Frank F. De Safey, 22240 Varian Way, Cupertino, Calif. 95014

[21] Appl. No.: 503,703

[22] Filed: Jul. 18, 1995

[51] Int. Cl.[6] ..... B65D 3/00

[52] U.S. Cl. ..... 229/67.2; 312/184

[58] Field of Search ..... 312/184; 229/67.1, 229/67.2

[56] References Cited

U.S. PATENT DOCUMENTS

| | | | |
|---|---|---|---|
| 2,563,226 | 8/1951 | Ellis | 312/184 X |
| 3,298,374 | 1/1967 | Grundell | 312/184 X |
| 4,031,646 | 6/1977 | de Nouël . | |
| 4,294,028 | 10/1981 | Remond . | |
| 5,066,045 | 11/1991 | Hawes, Jr. et al. . | |
| 5,197,762 | 3/1993 | Abramov | 312/184 X |

FOREIGN PATENT DOCUMENTS

| | | | |
|---|---|---|---|
| 244343 | 3/1963 | Australia | 312/184 |
| 909786 | 5/1946 | France | 312/184 |
| 508740 | 7/1939 | United Kingdom | 312/184 |
| 526470 | 9/1940 | United Kingdom | 312/184 |

OTHER PUBLICATIONS

Magnifiles Product Catalogue, Abbott Office Systems, 5012 Asbury Ave., Farmingdale, NJ 07727; tel. (800) 631-2233; fax (908) 938-4419, pp. 1-8 No Date.

*Primary Examiner*—Jes F. Pascua

*Attorney, Agent, or Firm*—Thomas Schneck; George B. F. Yee

[57] ABSTRACT

A coupling member is disclosed for connecting together adjacent hanging file folders. An elongate member includes a flat surface for attachment to a folder. A longitudinally formed slot is formed along the full length of the elongate member and positioned to receive the lip of the opening of an adjacent folder. In a preferred embodiment, the slot is defined by two spaced-apart surfaces which extend into the interior region of the elongate member. The interior region may be solid or may be partially or fully hollow. The elongate member has any one of a number of cross-sectional profiles, including semi-circular, rectilinear, triangular and concave shaped profiles. In another embodiment of the present invention, the coupling member is integrally formed with a hanging file folder. In a preferred variation, the coupling member is formed with hanging means such as tangs to assist in hanging the folder.

15 Claims, 3 Drawing Sheets

APPARATUS FOR CONNECTED FILE FOLDERS

TECHNICAL FIELD

The present invention relates generally to file folders and more specifically to an apparatus for connecting together hanging file folders.

BACKGROUND ART

File folders are one of the most readily recognized articles in an office setting. They are the means by which the numerous documents and other paperwork of a business are organized and maintained. Improvements in the construction and design of file folders have, over the years, increased their reliability and their utility. For example, the hanging folder described in U.S. Pat. No. 5,066,045 to Hawes, Jr. et al. discloses a hanging folder having reinforced strips along its top and bottom edges for protection against wear to the folder.

File folders typically are placed together in a file drawer so that each file is positioned adjacent to the next file. Because of such an arrangement, it occasionally occurs that a document which is intended to be inserted in a particular file inadvertently falls between the intended file and an adjacent file. Such misfiled papers may become lost or are not discovered until after a time-consuming search has been conducted.

A solution to this problem is described in U.S. Pat. No. 4,031,646 to deNouel, which discloses a suspensible file folder capable of connecting to an adjacent folder. A permanent magnet is affixed to one of the folder's two suspension hooks, and is exposed toward the outside of the folder. A ferromagnetic material is positioned on the other suspension hook and exposed in the opposite direction. In this manner, adjacent folders are coupled together by the magnetic attraction between the magnet of one folder and the ferromagnetic material of the adjacent folder. The coupling eliminates the space between folders and therefore the likelihood of misplacing a document. However, the parts used and the necessary manufacturing steps contribute significantly to the cost of the folders, and the additional components significantly increase the weight of folders so equipped.

Another interconnection mechanism is described in U.S. Pat. No. 4,294,028 to Reymond. The mechanism is a plate which is fixed to the surface of one folder and includes a pincer that is molded unitarily with the plate. The pincer engages with a corresponding male member attached to an adjacent folder, and thus effectuates a coupling between the two folders. See generally FIGS. 3–6. Reymond teaches that such components may be molded from a synthetic resin material. The Reymond coupling mechanism increases the cost of manufacture due to the complexity of the molded plate and the corresponding engagement member located on the adjacent folder.

In addition to misfilings between adjacent folders, it is further noted that current labeling schemes can be ineffective because the labels are usually of insufficient size to accommodate a fully descriptive title for the folder. A solution is offered in a product known as MAGNIFILES, marketed by ABBOT Office Systems. The product provides a folder having a coupling mechanism for coupling adjacent files, and further includes an enlarged area for labeling. The MAGNIFILES mechanism, however, is integrally formed with file folders that are specifically designed and manufactured to work with the mechanism. The folders have hanging members which have a thick design. This allows the MAGNIFILES mechanism to clamp onto an adjacent folder.

A shortcoming common to the above-described devices is the necessity for specially designed matching components. The prior art devices therefore are not capable of being used with file folders already in use in today's office environments.

What is needed is a file folder capable of being coupled to another folder, that is simpler to manufacture than the coupling mechanisms of the prior art and yet offers the desirous feature of preventing misfiled documents by eliminating the gap between adjacent folders. There is further need for a coupling member that can be used with existing non-connecting hanging files. It is also desirous to provide labeling of folders that is more effective than is presently available.

SUMMARY OF THE INVENTION

The present invention is directed to a file folder interlocking member composed of an elongate member having a flat surface along its exterior and having means for fastening the flat surface to a file folder. A slot is formed along the entire length of the elongate member and is positioned so as to receive the leaf of an adjacent folder. The elongate member has a semi-circular cross section so as to provide a curved surface for mounting file identification labels. Other profile contours are possible; for example, a planar surface can be provided for mounting labels instead of a curved surface.

In a particular embodiment of the invention, an adhesive strip is disposed along the flat surface and serves to adhere the elongate member to the folder. Alternatively, the elongate member includes at least one notch correspondingly positioned to fit into a slot of the folder normally used for inserting labels. By so doing, the interlocking member of the present invention can be detachably fixed to the folder.

In a preferred embodiment, the slot formed along the elongate member includes two spaced-apart surfaces which extend into the interior of the elongate member. In this way, the leaf of an adjacent folder frictionally engages the slot with significant frictional force, thus providing a reliable coupling of the adjacent folder.

In another embodiment of the present invention, the elongate coupling member is integrally manufactured with a hanging file folder. The coupling member is coupled to the external surface of a lip of the opening of the folder, so that the lip of an adjacent folder can engage the slot by insertion into the slot. In addition, the coupling member and a hanging means of the folder may be integrally formed, so that the coupling member serves both to couple together adjacent folders and to assist in suspending the folder.

The various embodiments of the present invention are more fully described with reference to the included drawings and to the following discussion of the best mode contemplated for practicing the invention. In the drawings, similar elements of the invention are referenced by the same reference numerals.

BEST MODE FOR CARRYING OUT THE INVENTION

Figure 1:
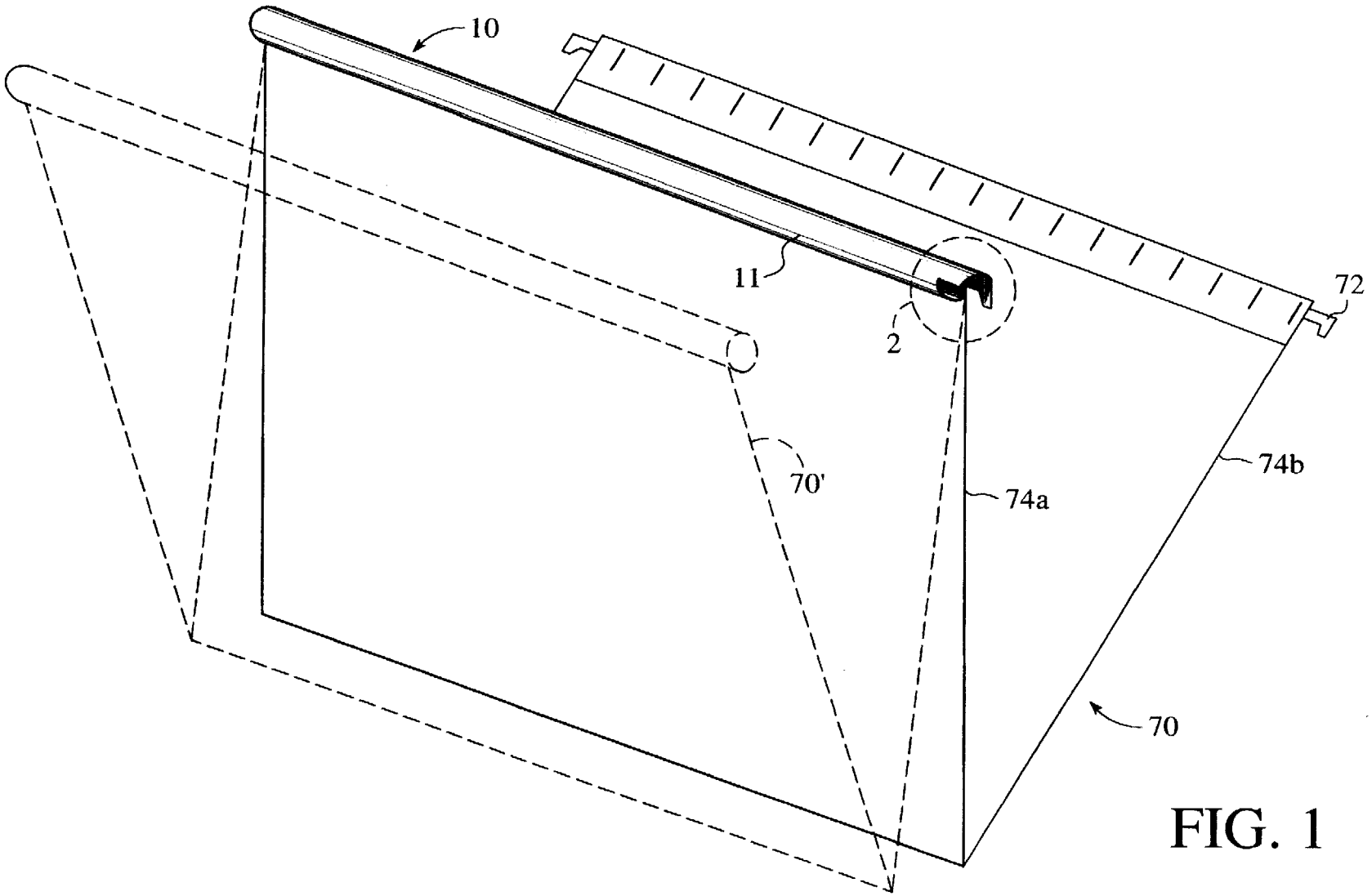
FIG. 1 shows a preferred embodiment of the coupling member used with a hanging file folder in accordance with the present invention.

FIG. 1 shows a folder interlocking (or coupling) member 10 in accordance with the present invention, attached to one flap 74A of a hanging file folder 70. The elongate body 11 of the coupling member 10 generally spans the width of the folder 70. File folders typically are produced in standard widths to accommodate documents such as letter size (11 inch) and legal size (14 inch) paper. It should be apparent, however, that the elongate body 11 can be easily manufactured to fit any of the standard sized folders, and more generally can be manufactured to fit folders having non-standard arbitrary widths. FIG. 1 further shows an adjacent folder 70', shown in phantom, coupled to the first folder 70 by the coupling member 10.

Figure 2:
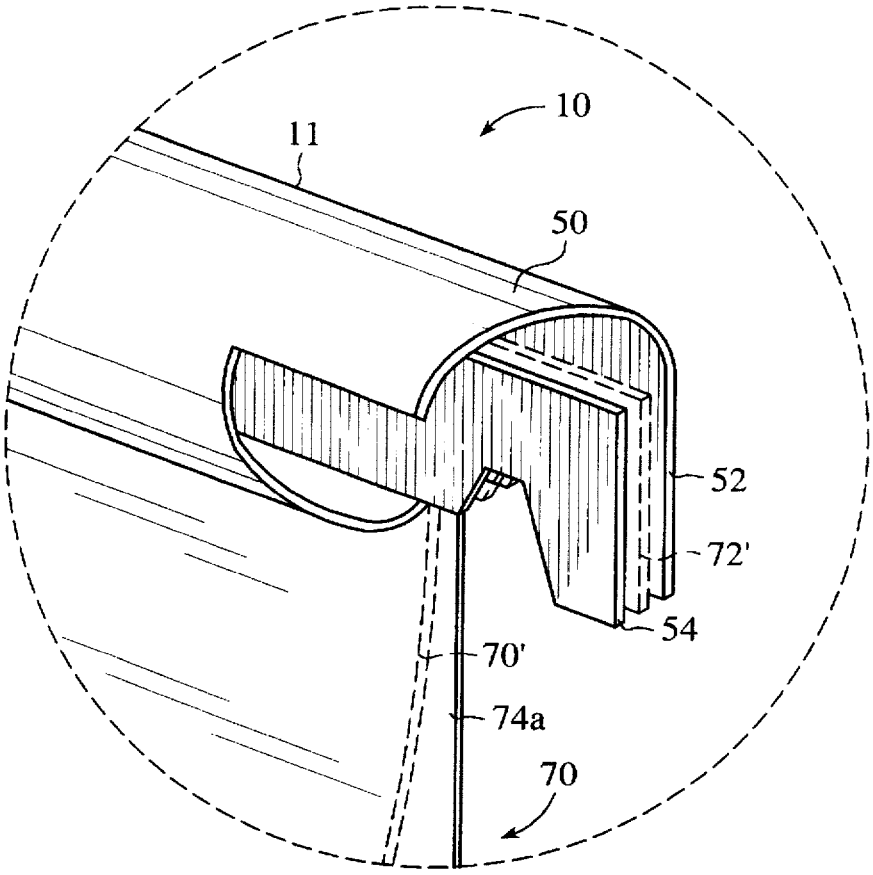
FIG. 2 is an enlargement of FIG. 1, illustrating the attachment of the coupling member to the file folder.

FIG. 2 is an enlargement of the circled region in FIG. 1. FIG. 2 shows in greater detail the positioning of the coupling member 10 with respect to the first folder 70 and the adjacent folder 70', as contemplated in the present invention. The extended portion 50 at each end of the elongate body 11 extends over the tangs or hooks 72' of the adjacent folder 70' to achieve a more visually pleasing effect. The additional structures shown in FIG. 2 will now be explained with further reference to FIG. 3.

Figure 3:
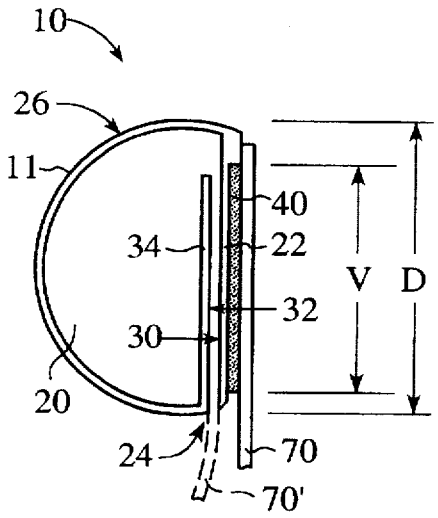
FIG. 3 is a cross-sectional view of the preferred embodiment of the coupling member of the present invention.

Turning to FIG. 3, additional detail is provided in a cross-sectional view of the elongate body 11. In the preferred embodiment, the elongate body is a hollow member having a hollow interior 20. The cross-sectional profile of the elongate body has a semi-circular shape 26. A flat portion 22 of the semi-circle is positioned proximal to an exterior surface of the folder 70. Returning to FIG. 3, the semi-circular profile 26 has a typical outside diameter measurement D on the order of one-half of one inch. The vertical measurement V of the flat portion 22 is roughly one-quarter of one inch. An adhesive strip 40 disposed along the flat portion 22 provides attachment of the coupling member 10 to the folder 70 by being pressed against the surface of the folder. It is to be noted that the elongate body 11 need not be fully hollow as shown in FIG. 3, and may be composed of a solid member or be formed with an interior region having some internal structure.

FIGS. 2 and 3 illustrate that the slot 24 is further defined by two spaced apart parallel surfaces 30, 32. As can be seen in FIG. 3, the first surface 32 is formed by extending a portion 34 of the elongate body 11 into its interior 20. The opposite surface 30 is conveniently obtained as the interior surface of the flat portion 22. It is noted that, alternatively, the opposite surface 30 may be formed independently of the flat portion 22. That is, another portion (not shown) of the elongate body 11 may be extended into the interior 20 to define a surface opposite to the first surface 32, in much the same way that the first surface is formed.

The opposed surfaces 30, 32 are separated by a distance at most equal to the thickness of the lip of an adjacent folder 70', typically on the order of one-sixteenth of an inch. When the lip is inserted into the slot 24, the action tends to widen the slot causing the surfaces to flex. This flexure results in a force which tends to return the surfaces to their original unflexed positions. The closing tendency, along with the contact surface area between the lip and the surfaces 30, 32, provide a very reliable friction fit of the adjacent folder. This arrangement allows for use with existing file folders since special coupling mechanisms or specially designed folders such as described in the prior art are not required.

As can be seen in each of FIGS. 1, 2 and 3, the elongate body 11 occludes the gap between the two adjacent folders 70, 70' that are connected together by the coupling member 10, thereby eliminating the possibility of inadvertently misfiling a document between the two folders. The slot 24 is preferably formed close to the flat portion 22 so that the spacing between folders is kept to a minimum. However, the slot may be spaced apart from the flat portion without affecting the utility of the coupling member 10.

Turning to FIG. 2, it is shown that the coupling member 10 further includes unitarily formed hanging members (tangs) 52 and 54 which assist in supporting the file folder. It is noted that various alternate configurations are readily apparent. For example, the coupling member may be fabricated with just one hanging member 52 or 54, and still provide support for the file folder. One such configuration is exemplified in FIG. 4, which illustrates a coupling member having only one hanging member 52.

Figure 6:
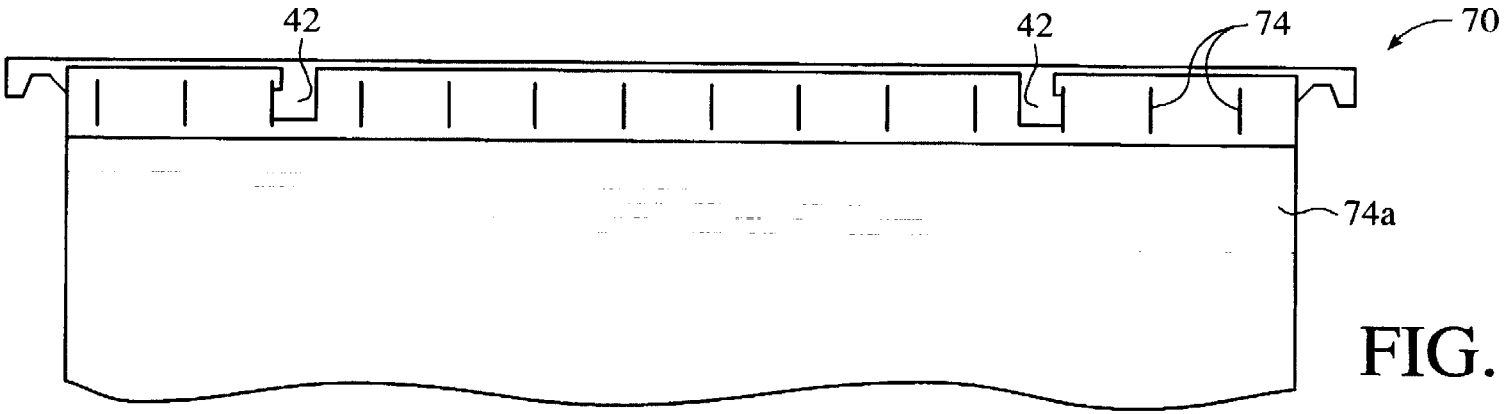
FIGS. 5 and 6 are two views of a variation of the embodiment illustrated in FIG. 3.
Figure 5:
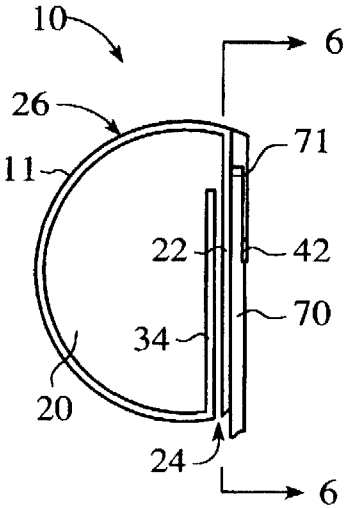

As an alternative to the adhesive strip 40 shown in FIG. 3, FIGS. 5 and 6 show a hooked notch 42 for providing attachment of the coupling member 10 to the folder 70. Typically, folders are formed with slots disposed along the inside surface of the lips for the insertion of file folder tabs. These slots can be utilized by the hooked notch 42 for attaching the coupling member.

Referring to FIG. 5, the hooked notch 42 is disposed along the elongate body 11 and is spaced apart from the flat portion 22. The notch may be an integral portion of the elongate body 11, or may be a separate component that is affixed to the elongate body. The lip 71 of the folder is received between the exterior surface of the flat portion 22 and the notch 42. Turning to FIG. 6, the notch 42 is shown engaged within a slot 74 formed in the folder 70, thereby pressing the exterior surface of the flat portion 22 against the folder. The hooked notch 42 allows detachable coupling of the coupling member 10, and so provides for re-use of the coupling member.

The hook portion of the notch 42 which fits into the slot may be oriented in any one of a number directions. In a preferred embodiment, the coupling member includes two hooked notches 42, wherein the hook portions are directed away from each other, as shown in FIG. 6. In an alternate embodiment, the hook portions may be oriented to face toward each other (not shown) or such that each faces to the left or to the right (not shown). The arrangement of the hooks in the notches 42 of the preferred embodiment provides a secure attachment of the coupling member 10 to the folder 70.

Figure 7:
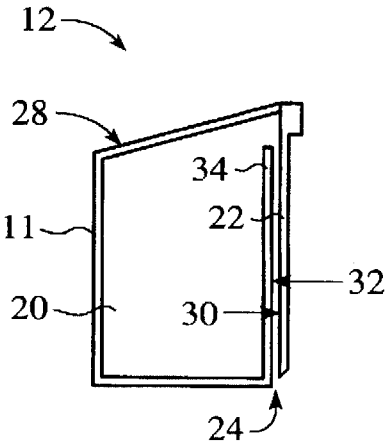
FIG. 7 illustrates an embodiment wherein the coupling member includes a transverse flat surface.

Returning to FIG. 1, it can be seen that the exterior surface of the coupling member 10 is ideal for use as a labeling area, using either permanently attached labels or removable labels. Informative folder titles are possible since the entire exposed portion of the elongate body 11 is available. FIG. 7 illustrates an alternative embodiment wherein the cross-sectional profile of the coupling member 12 has a shape that is not semi-circular. In particular, FIG. 7 shows an elongate body 11 having a rectangular profile with an upwardly-facing flat surface 28. A flat surface further facilitates the placement of folder identification labels, and if desired allows for folder titles to be written directly on the surface. In general, the shape of the cross-sectional profile is not limited to those shown in the figures; other shapes are possible including a concave surface, a triangular profile and a generally rectilinear profile such as a square shape.

Figure 4:
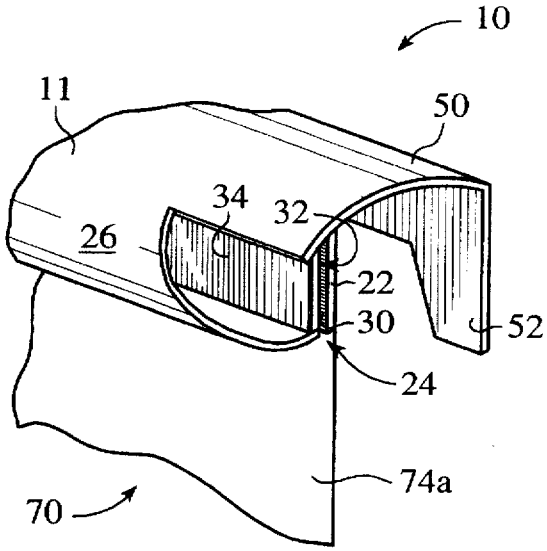
FIG. 4 shows a perspective view of an alternate construction of the coupling member shown in FIG. 2, and also serves to illustrate an embodiment of the present invention in which the coupling member is integrally manufactured with the file folder.

In yet another embodiment of the present invention, turn now to the illustration in FIG. 4 which shows a coupling member 10 that is integrally formed with a hanging folder 70. A file folder typically includes a pair of tangs 72 (see FIG. 1) on each of the two flaps 74A, 74B of the folder. In this embodiment, the flat surface 22 of the coupling member 10 is integrally formed with one of the flaps 74A of the hanging folder 70, and so the tangs 72 normally found on the flap 74A are replaced by the tangs 52 of the coupling member 10. Alternatively, tangs 54 (see FIG. 2) may be used instead of tangs 52. Finally, both tangs 52, 54 may be provided, as shown in FIG. 2.

Figure 8:
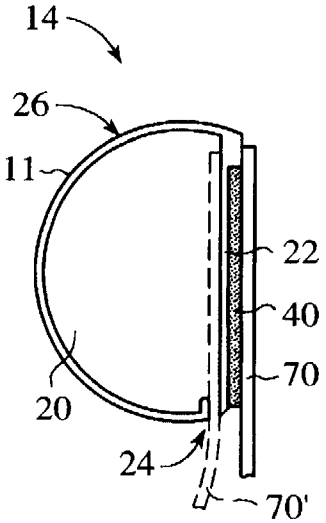
FIG. 8 is a cross-sectional view illustrating an embodiment of the coupling member wherein the slot does not include spaced-apart surfaces.

FIG. 8 shows a coupling member 14 of the present invention in which a longitudinal slot 24 is formed simply as an opening into the interior of the elongate body 11. The slot receives the lip of an adjacent folder 70' for insertion into the hollow interior 20 of the coupling member, thereby coupling the two folders 70, 70' together. The width of the slot 24 is on the order of one-sixteenth of an inch, so that insertion of the lip of an adjacent folder into the slot causes some degree of flexure of the elongate body 11, tending to widen the slot. The closing tendency of the flexed elongate body 11 serves to grip the lip of the adjacent folder, thus holding the adjacent folder in place.

The foregoing has been a description of the best mode contemplated for practicing the present invention. It is not intended that the practice of the invention solely be limited to the above-described embodiments. It is fully understood that enhancements, additions and modifications may be provided without departing from the spirit and the scope of the invention. For example, the coupling members may be manufactured from material such as a PVC-based resin or some other commonly used type of plastic, or may be formed out of metal stock such as aluminum. In addition, the coupling members may be provided in various colors and combinations of colors in order to further increase their utility. With respect to the embodiment illustrated in FIG. 4, the depth of the folder 70 need not be limited to hold the standard eight and one-half inch wide documents, but can be any arbitrary depth. It is apparent that various embodiments of the present invention would be well within the capabilities of a person of ordinary skill in the art and would fall within the true spirit and scope of the invention as defined by the claims which follow.

I claim:

1. A folder interlocking member for coupling adjacently positioned folders having a pair of joined leaves, said folder interlocking member comprising:

an elongate member extending a length substantially equal to the width of a folder, said elongate member having an interior region and having a first flat exterior surface formed along the length thereof;

an adhesive strip disposed along a substantial length of said first flat exterior surface in order to affix said elongate member to a leaf of a folder; and a longitudinal slot, opening into said interior region, formed along the full length of said elongate member in a position to receive a leaf of an adjacent folder.

2. The folder interlocking member of claim 1 wherein said longitudinal slot is formed adjacent to said first flat surface.

3. The folder interlocking member of claim 2 wherein said longitudinal slot includes two substantially parallel spaced apart surfaces extending into said interior region of said elongate member.

4. The folder interlocking member of claim 3 wherein said spaced apart surfaces longitudinally extend along the entire length of said elongate member.

5. The folder interlocking member of claim 4 wherein at least one of said spaced-apart surfaces includes a hanging portion formed proximal to each end of said elongate member.

6. The folder interlocking member of claim 1 wherein said elongate member has one of a semi-circular, rectilinear, triangular and concave cross section.

7. The folder interlocking member of claim 1 wherein said elongate member includes a second flat surface formed along the length thereof and lies along a plane that intersects the plane of said first flat surface.

8. The folder interlocking member of claim 1 wherein said elongate member is substantially hollow.

9. A folder interlocking member for coupling adjacently positioned folders having a pair of joined leaves, said leaves having a plurality of slots formed along top edges thereof, said folder interlocking member comprising:

an elongate member having an interior region and having a first flat exterior surface formed along the length thereof;

means for fastening said first flat surface to a folder, including a notch correspondingly positioned to engage one of said slots and having a shade to fit into one of said slots, whereby said elongated member is detachably affixed to said folder by fitting said notch to one of said slots; and a longitudinal opening formed along the full length of said elongate member in a position to receive a leaf of an adjacent folder.

10. The folder interlocking member of claim 9 wherein said longitudinal opening is formed adjacent to said first flat surface.

11. The folder interlocking member of claim 10 wherein said longitudinal opening includes two substantially parallel spaced apart surfaces extending into said interior region of said elongate member.

12. The folder interlocking member of claim 11 wherein said spaced apart surfaces longitudinally extend along the entire length of said elongate member.

13. The folder interlocking member of claim 12 wherein at least one of said spaced-apart surfaces includes a hanging portion formed proximal to each end of said elongate member.

14. The folder interlocking member of claim 9 wherein said elongate member has one of a semi-circular, rectilinear, triangular and concave cross section.

15. The folder interlocking member of claim 9 wherein said elongate member includes a second flat surface formed along the length thereof and lies along a plane that intersects the plane of said first flat surface.

* * * * *